United States Patent [19]

Cowell

[11] Patent Number: 4,821,473

[45] Date of Patent: Apr. 18, 1989

[54] CHIMNEY BY-PASS

[76] Inventor: Ernest E. Cowell, 921 Saltrising Rd., Bolivar, N.Y. 14715

[21] Appl. No.: 176,322

[22] Filed: Mar. 31, 1988

Related U.S. Application Data

[63] Continuation-in-part of Ser. No. 059,757, Jun. 8, 1987, abandoned, which is a continuation-in-part of Ser. No. 025,189, Mar. 12, 1987, abandoned.

[51] Int. Cl.[4] ..... E04H 12/28

[52] U.S. Cl. ..... 52/218; 52/317; 98/42.15; 98/58; 126/297; 126/504; 126/521; 126/536

[58] Field of Search ..... 52/21 B, 219, 317; 98/48, 58, 42.15, 42.16, 42.19; 126/287.5, 288, 297, 120

[56] References Cited

U.S. PATENT DOCUMENTS

| | | | |
|---|---|---|---|
| 538,976 | 5/1895 | McGuire et al. | 98/48 |
| 1,439,925 | 12/1922 | Street | 98/48 |
| 1,480,488 | 1/1924 | De Vos et al. | 98/48 |
| 2,713,301 | 7/1955 | McKann | 52/218 |
| 4,434,784 | 3/1984 | Van Patten | 126/312 |
| 4,487,137 | 12/1984 | Horvat et al. | 110/160 |
| 4,519,458 | 5/1985 | Kroeter | 169/56 |
| 4,616,457 | 10/1986 | Yoder et al. | 52/218 |
| 4,646,847 | 3/1987 | Colvin | 126/287.5 |

FOREIGN PATENT DOCUMENTS

| | | | |
|---|---|---|---|
| 524029 | 8/1921 | France | 126/297 |
| 2094 | 8/1921 | France | 98/58 |
| 2499215 | 8/1982 | France | 52/218 |

*Primary Examiner*—David A. Scherbel
*Assistant Examiner*—Caroline D. Dennison
*Attorney, Agent, or Firm*—Richard C. Litman

[57] ABSTRACT

A chimney by-pass is disclosed for use with a main chimney. In case of a chimney fire, a movable damper closes off the main chimney, substantially reducing the severity of the chimney fire. The movable damper also opens an auxiliary chimney, allowing smoke to exit, uninterrupted through the auxiliary chimney, and may include a fan to assist the exit of smoke into the atmosphere. The movable damper may be actuated manually or automatically in case of a chimney fire.

7 Claims, 4 Drawing Sheets

CHIMNEY BY-PASS

BACKGROUND OF INVENTION

This application is a continuation-in-part of U.S. patent application Ser. No. 059,757 filed on June 8, 1987, which is a continuation-in-part of U.S. patent application Ser. No. 025,189 filed on Mar. 12, 1987, both now abandoned.

FIELD OF INVENTION

The threat and occurrence of chimney fires has created a long felt need for improved safety among home owners and residents. Creosote deposits and other debris will accumulate in a chimney, often leading to a sudden chimney fire. The heat generated by such a fire is damaging to the masonry of the chimney. More importantly, these chimney fires often spread to destroy the entire building. Further, sparks from a chimney fire may land on the roof of the building or neighboring buildings, spreading the fire to these areas.

The invention relates to a chimney by-pass device which serves two vital functions in case of a chimney fire. First, the invention provides means for closing off the main chimney below the chimney fire, thereby cutting off oxygen to the chimney fire and substantially reducing the flame and heat from it. Second, the invention provides means for allowing smoke from the fireplace, wood stove, or other fire source to escape through an auxiliary chimney. Therefore, the invention provides reduction of the dangerous chimney fire, without disturbance of the primary fire.

DESCRIPTION OF THE PRIOR ART

Various prior art chimney safety devices, chimney dampers, and the like, as well as their apparatuses and the method of their construction in general, are known and are found to be exemplary of the U.S. prior art.

U.S. Pat. No. 4,616,457 to Yoder et al. discloses an enhanced safety flue construction which maintains higher temperatures in the upper portion of the chimney, thereby reducing the likelihood of fire while reducing the build-up of creosote in the chimney.

U.S. Pat. No. 2,900,893 to H.A. Wiedenroth discloses a chimney draft regulator which relates to devices that have adjusting means for regulating the cross area of the chimney.

U.S. Pat. No. 2,622,588 to J. Koberling, Sr. discloses a device relating to a damper element contained in a chimney, wherein the device allows for the proper range of movement of the damper element, thus providing an improved water catching means for the chimney.

While the prior art in chimney dampers is well known, the invention is a substantial improvement in that it provides for rapid and effective reduction of the chimney fire without disturbance to the main fire.

These patents or known prior uses teach and disclose various types of chimney safety devices, chimney dampers and the like, as well as methods of their construction; but none of them, whether taken singly or in combination, disclose the specific details of the combination of the invention in such a way as to bear upon the claims of the present invention.

SUMMARY OF THE INVENTION

An object, advantage and feature of the invention is to provide a novel chimney by-pass that is safe and efficient in use, and which serves the dual functions of reducing the severity of a chimney fire and handling smoke.

Another object of the invention is to provide a novel and improved construction of a movable damper, which may be manually or automatically activated in case of chimney fire.

Another object of the invention is to provide a novel and improved construction of an auxiliary chimney, to wit, the employment of an auxiliary chimney including a fan to assist the exit flow of smoke.

Yet another object of the invention is to provide a novel and improved chimney by-pass device which is easily installed in new or existing fireplaces.

Another object, advantage and feature of the invention is to provide a chimney by-pass device which uses a minimum of components, and is highly reliable and convenient in use. For example, in the case of a household chimney fire, the resident could immediately actuate the by-pass device, reducing the chimney fire without having smoke enter the house.

These, together with other objects and advantages of the invention reside in the details and the process and the operation thereof, as is more fully hereinafter described and claimed. References are made to the drawings forming a part hereof, wherein like numerals refer to like parts throughout.

DESCRIPTION OF THE PREFERRED EMBODIMENT

Figure 1:
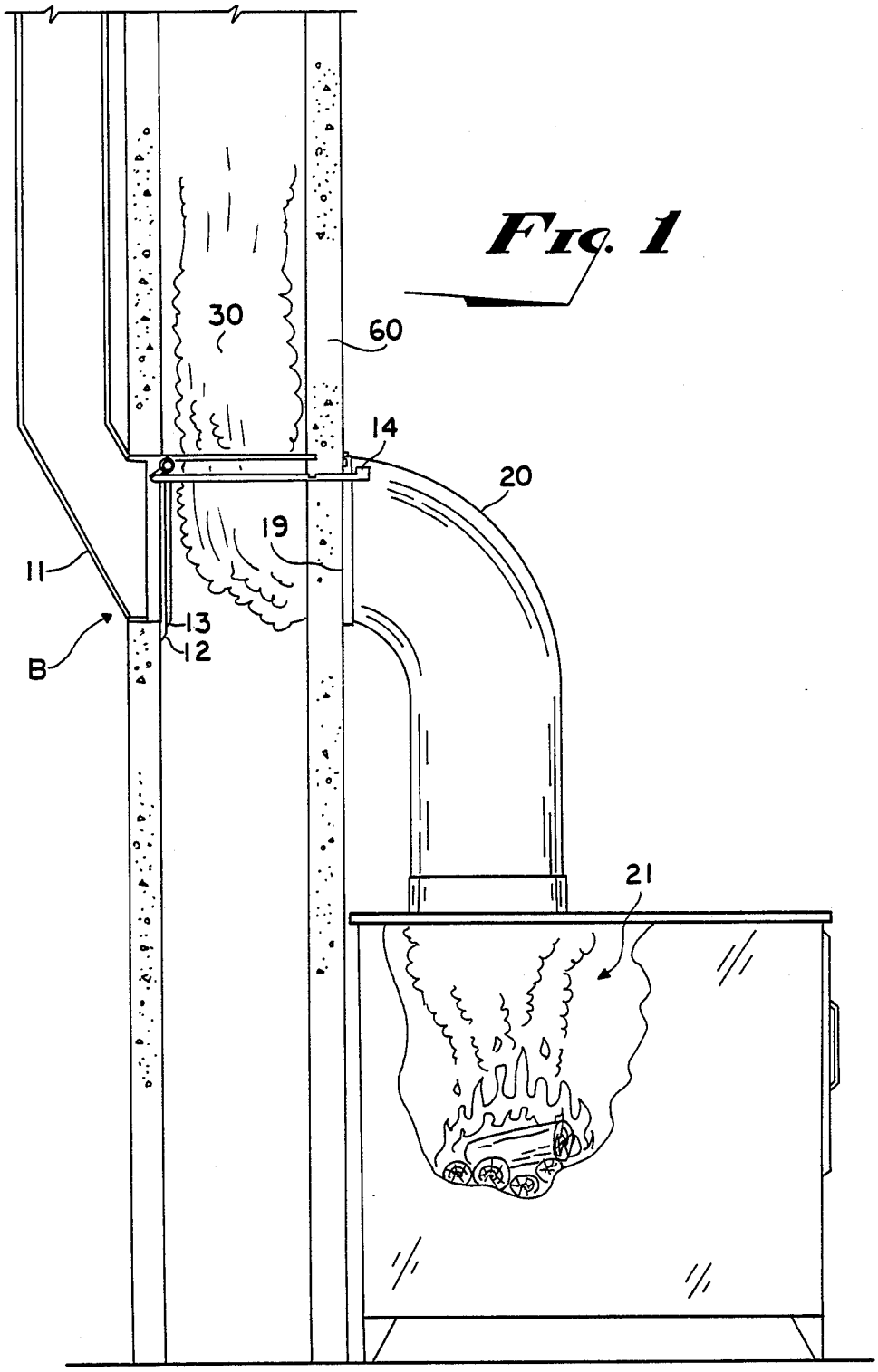
FIG. 1 is a side view of a chimney by-pass installed in a main chimney, showing the normal path of smoke flow through the main chimney.

Referring now to the drawings, in which like numerals refer to like elements throughout, there is shown in FIG. 1 a chimney by-pass B installed in a main chimney 60. FIG. 1 shows the normal operation of the main chimney 60 with the bypass in it's first operational position. In this example, a wood burning stove 21 or other fire source, is producing smoke 30 that enters the chimney 60 through a thimble 20. The smoke 30 then enters chimney 60 through aperture 19. The smoke 30 then exits to the atmosphere through main chimney 60. During normal operation, the damper 12 closes off auxiliary chimney 11, permitting smoke 30 to exit through main chimney 60. The damper 12 may be provided with a protective material 13, such as any suitable material having a high heat resistance and chemical resistance, so that it prevents the damper 12 from sticking due to corrosion or creosote buildup. Further, the protective material 13 insulates damper 12 form heat, thereby preventing warping of the damper 12.

Figure 1A:
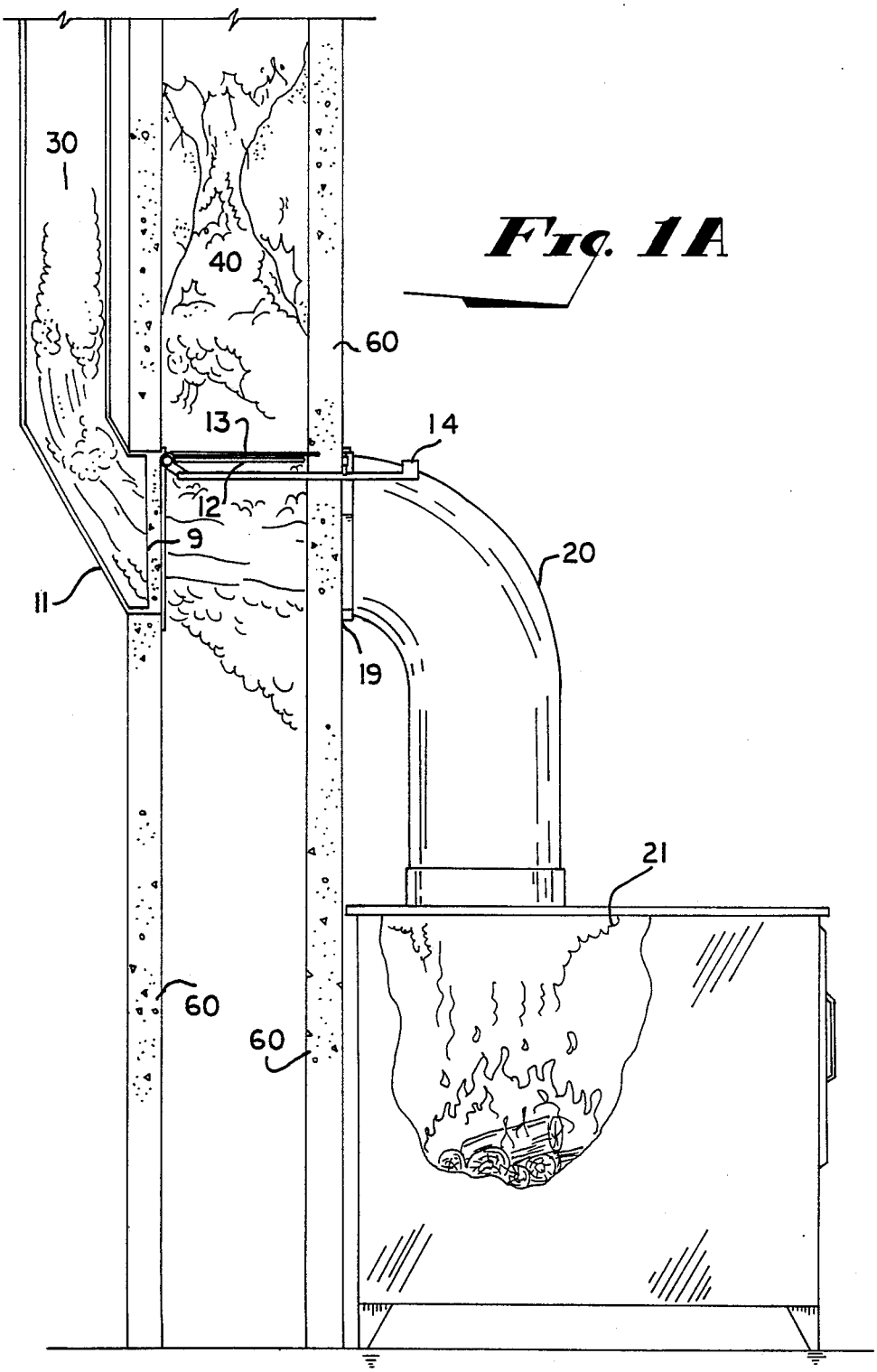
FIG. 1A is a view similar to FIG. 1, showing the chimney by-pass reducing a chimney fire, and the path of smoke flow through the auxiliary chimney.

In the occurrence of a chimney fire 40 as shown in FIG. 1A, the damper 12 is swung into its second operational position as shown. The damper 12 may be swung up into position manually by rod 14 shown. Alternatively, the damper 12 may be actuated by an automatic sensor and automatic actuator (not shown). In the second operational position shown in FIG. 1A, the damper 12 closes chimney 90, thereby cutting off oxygen to chimney fire 40 and reducing the flame and heat from it. The damper 12 also opens aperture 9 into auxiliary chimney 11, thereby allowing smoke 30 from the wood burning stove 21 or other fire source to escape into the atmosphere through auxiliary chimney 11. In this way, the invention prevents smoke 30 from backing up into the room where the wood stove 21 is located, and further eliminates the need to extinguish the fire in the wood stove 21 or primary fire source.

Figure 2:
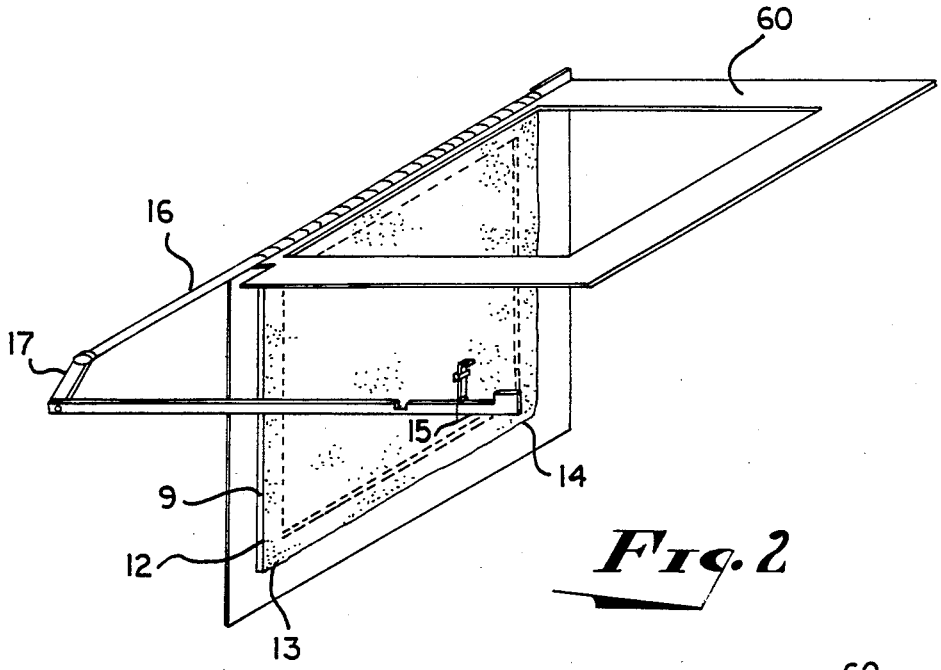
FIG. 2 is a perspective view of the damper assembly.
Figure 3:
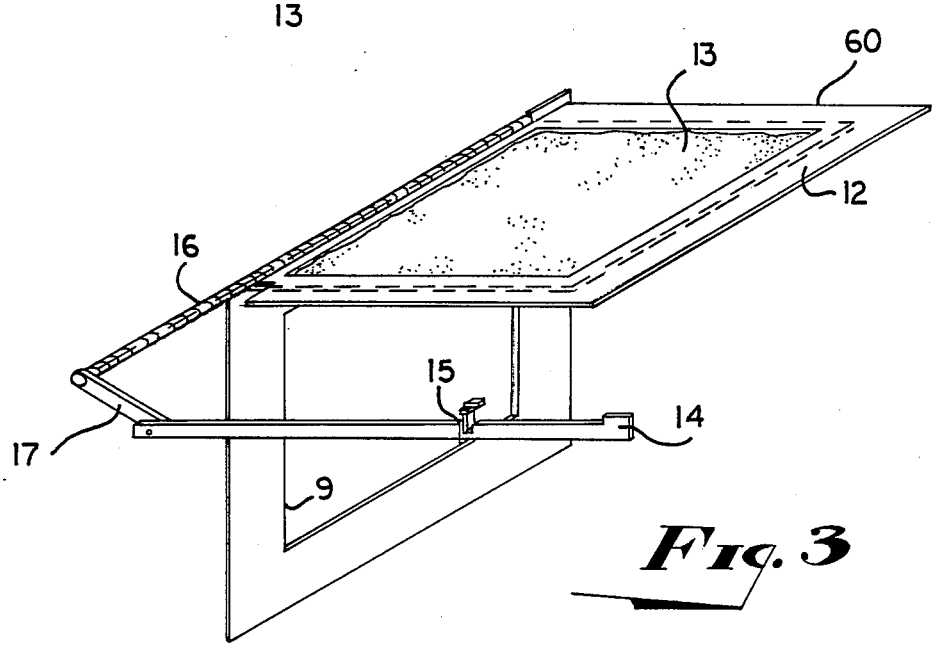
FIG. 3 is a view of the damper assembly similar to FIG. 2, and shows the damper in an upward position.

FIGS. 2 and 3 show respectively the first and second operational positions of the damper 12 in more detail. In the first position shown in FIG. 2, damper 12 is closed against aperture 9, thereby closing off the auxiliary chimney when not needed. The protective material 13 is shown facing into the interior if chimney 60. In the case of a chimney fire, rod 14 is pulls inward, pulling on lever 17, thereby rotating damper 12 upward about hinge 16. As shown in FIG. 3, damper 12 may be locked in its second operational position by a latch 15 or other suitable locking means. In this position, damper 12 closes off main chimney 60, and opens aperture 9 into the auxiliary chimney.

Figure 4:
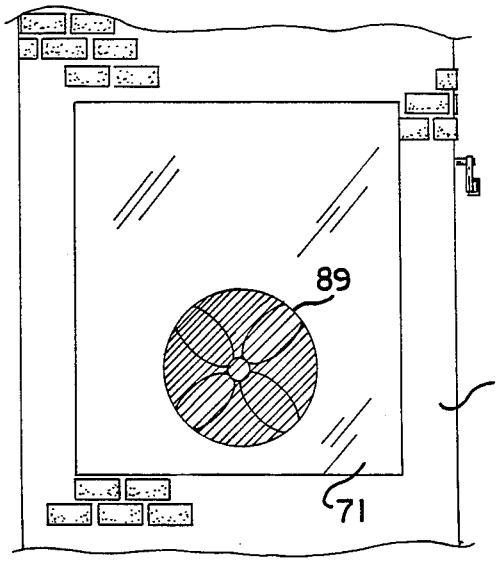
FIG. 4 shows a front view of an alternative embodiment of the auxiliary chimney.
Figure 5:
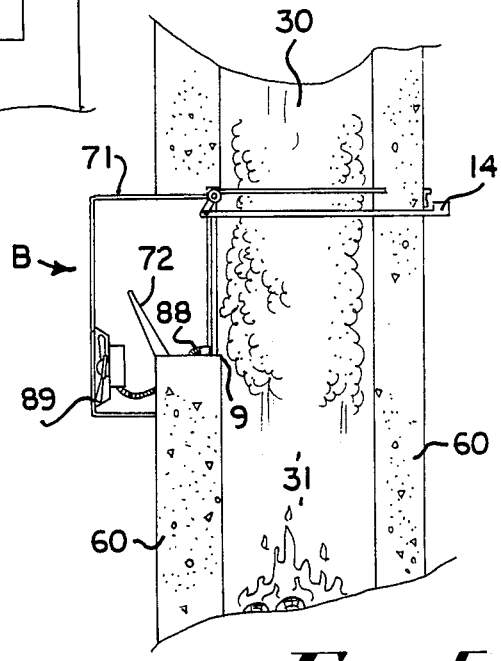
FIG. 5 is a side view of an alternative embodiment of the auxiliary chimney, showing the path of smoke flow out of the main chimney.
Figure 5A:
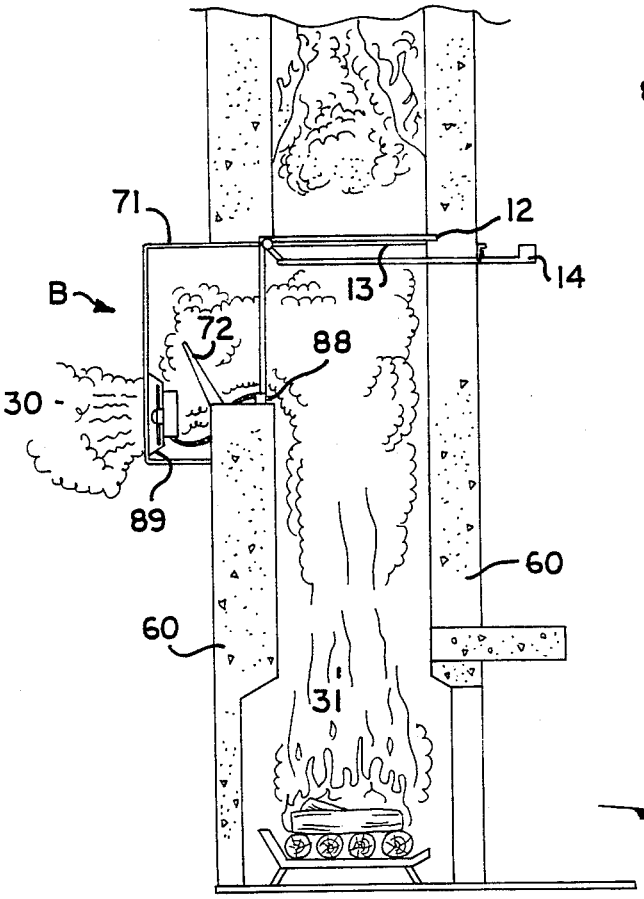
FIG. 5A is a view similar to FIG. 5 showing the by-pass reducing a chimney fire, and smoke exiting through the auxiliary chimney.

FIGS. 4, 5 and 5A show an alternative embodiment of the auxiliary chimney 71. This embodiment is particularly suited for installation in existing chimneys or in new or existing fireplace chimneys. FIG. 4 shows the outside of the alternative auxiliary chimney structure 71. As can be seen, this embodiment provides a compact and aesthetic structure well suited for residential applications. FIG. 5 shows the by-pass B with the damper 12 closing off the auxiliary chimney, thereby allowing smoke 30 from fireplace 31 to exit through main chimney 60. In case of a chimney fire, FIG. 5A shows the damper 12 closing off the main chimney 60 to substantially reduce chimney fire 40. In this position, the damper opens aperture 9 to auxiliary chimney 71. As the smoke 30 enters auxiliary chimney 71, it is deflected by heat deflector 72, and follows a convoluted path to exhaust fan 89, which urges the smoke 30 out to the atmosphere. The invention may be provided with a switch 88 to automatically turn on the fan 89 when the damper 12 is swung into its upward position.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications, and equivalents which may be resorted to, fall within the scope of the invention.

I claim:

1. A chimney by-pass for use with a main chimney to reduce chimney fires and handle smoke, comprising;

an auxiliary chimney;

a movable damper;

means for moving said movable damper, thereby closing said main chimney and opening said auxiliary chimney.

2. The chimney by-pass of claim 1, wherein;

said auxiliary chimney includes one end defining a first aperture into said main chimney, whereby smoke may exit said main chimney through said first aperture into said auxiliary chimney; and said auxiliary chimney including another end open to the atmosphere.

3. The chimney by-pass of claim 1, wherein;

said movable damper is shiftable between two operational positions, whereby in a first operational position said movable damper closes said auxiliary chimney and a second operational position said movable damper closes said main chimney and opens said auxiliary chimney.

4. The chimney by-pass of claim 1, wherein:

said auxiliary chimney includes a container having one side defining a first aperture into said main chimney, said container having another side defining a second aperture open to the atmosphere; and a fan disposed in said second aperture of said container to urge smoke within said container into the atmosphere.

5. The chimney by-pass of claim 1, including;

a layer of insulating material attached to said movable damper to protect said movable damper from heat and smoke buildup.

6. The chimney by-pass of claim 1, including;

means for sensing a fire in said main chimney; and indicating means operable upon actuation of said sensing means.

7. The chimney by-pass of claim 6, including;

automatic means for actuating said movable damper in response to actuation of said sensing means.

* * * * *